US010978266B2

(12) United States Patent
Lee et al.

(10) Patent No.: US 10,978,266 B2
(45) Date of Patent: Apr. 13, 2021

(54) ELECTROMECHANICAL SWITCH HAVING MOVABLE CONTACT AND DAMPENER

(71) Applicant: TE CONNECTIVITY CORPORATION, Berwyn, PA (US)

(72) Inventors: Albert Yong Lee, Greensboro, NC (US); Roger Lee Thrush, Clemmons, NC (US)

(73) Assignee: TE Connectivity Corporation, Berwyn, PA (US)

( * ) Notice: Subject to any disclaimer, the term of this patent is extended or adjusted under 35 U.S.C. 154(b) by 267 days.

(21) Appl. No.: 15/961,093

(22) Filed: Apr. 24, 2018

(65) Prior Publication Data

US 2019/0326085 A1 Oct. 24, 2019

(51) Int. Cl.

| | |
|---|---|
| ***H01H 50/04*** | (2006.01) |
| ***H01H 50/64*** | (2006.01) |
| ***H01H 50/20*** | (2006.01) |
| ***H01H 50/60*** | (2006.01) |
| ***H01H 50/56*** | (2006.01) |
| ***H01H 50/02*** | (2006.01) |
| *H01H 50/54* | (2006.01) |

(52) U.S. Cl.

CPC ..... *H01H 50/56* (2013.01); *H01H 50/02* (2013.01); *H01H 50/641* (2013.01); *H01H 50/546* (2013.01); *H01H 2221/062* (2013.01)

(58) Field of Classification Search

CPC ..... H01H 50/02; H01H 50/546; H01H 50/56; H01H 50/641; H01H 2221/062; H01H 50/305

See application file for complete search history.

(56) References Cited

U.S. PATENT DOCUMENTS

| | | | | |
|---|---|---|---|---|
| 5,394,128 | A | 2/1995 | Perreira et al. | |
| 8,552,823 | B2 * | 10/2013 | Isonaga | H01H 50/20 335/126 |
| 2004/0000981 | A1 * | 1/2004 | Thrush | H01H 50/305 335/172 |
| 2006/0050466 | A1 * | 3/2006 | Enomoto | H01H 50/02 361/160 |

(Continued)

FOREIGN PATENT DOCUMENTS

WO 2011161919 A1 12/2011

OTHER PUBLICATIONS

International Search Report, International Application No. PCTIB2019/052922, International Filing Date, dated Apr. 9, 2019.

*Primary Examiner* — Bernard Rojas

(57) ABSTRACT

An electromechanical switch includes a housing, first and second stationary contacts mounted to the housing, a movable contact, and a carrier sub-assembly. The housing has a divider wall. The carrier sub-assembly includes a support rod that extends through an aperture in the divider wall and is coupled to the movable contact. The carrier sub-assembly is configured to move the movable contact relative to the first and second stationary contacts. The carrier sub-assembly includes a contact spring surrounding the support rod between the divider wall and the movable contact. The carrier sub-assembly also includes a dampener in engagement with the contact spring. The dampener is configured to absorb vibration along one or more of the contact spring or the movable contact.

20 Claims, 5 Drawing Sheets

(56) References Cited

U.S. PATENT DOCUMENTS

| | | | | |
|---|---|---|---|---|
| 2006/0109070 | A1* | 5/2006 | Hirabayashi | H01H 51/065 335/126 |
| 2011/0032059 | A1* | 2/2011 | Ito | H01H 50/14 335/202 |
| 2013/0076464 | A1* | 3/2013 | Yano | H01H 51/00 335/193 |
| 2013/0214884 | A1* | 8/2013 | Ito | H01H 50/02 335/153 |
| 2014/0167892 | A1* | 6/2014 | Hirabayashi | H01H 51/065 335/203 |
| 2015/0042426 | A1* | 2/2015 | Ignatov | H01H 50/546 335/193 |
| 2016/0365209 | A1 | 12/2016 | Blackmon et al. | |

* cited by examiner

ELECTROMECHANICAL SWITCH HAVING MOVABLE CONTACT AND DAMPENER

BACKGROUND OF THE INVENTION

The subject matter herein relates generally to electromechanical switches (e.g., contactors or relays) that control a flow of electrical power through a circuit.

Electromechanical switches may be used in a number of applications in which it is desirable to selectively control the flow of electrical power (e.g., current). Electromechanical switches, such as contactors or relays, may include a movable contact and a plurality of stationary contacts. The movable contact is selectively moved to engage or disengage the stationary contacts. When the movable contact is engaged to the stationary contacts, electrical power may flow through the contacts. The electrical power may not flow through the contacts when the movable contact is spaced apart from the stationary contacts.

In certain applications, an audible noise is generated along the interfaces between the movable contact and the stationary contacts. For example, an electric vehicle uses an electric vehicle battery (EVB) or a traction battery to power the vehicle. Such batteries may include individual cells having one or more contactors. When an individual presses the accelerator pedal, the movable contact of at least one of the contactors is moved to engage the stationary contacts. If the individual rapidly and/or deeply presses the accelerator pedal to quickly accelerate the vehicle, a surge of current flows through the movable contact and the stationary contacts. This surge of current may cause the movable contact to oscillate and vibrate, which generates the audible noise. The audible noise can be distracting or annoying to individuals within the vehicle as well as to individuals near the vehicle.

Accordingly, a need remains for an electromechanical switch that prevents or at least diminishes the audible noise caused by oscillation of the contacts at the contact interfaces.

BRIEF DESCRIPTION OF THE INVENTION

In one or more embodiments of the present disclosure, an electromechanical switch is provided that includes a housing, first and second stationary contacts mounted to the housing, a movable contact, and a carrier sub-assembly. The housing has a divider wall. The carrier sub-assembly includes a support rod that extends through an aperture in the divider wall and is coupled to the movable contact. The carrier sub-assembly is configured to move the movable contact relative to the first and second stationary contacts. The carrier sub-assembly includes a contact spring surrounding the support rod between the divider wall and the movable contact. The carrier sub-assembly also includes a dampener in engagement with the contact spring. The dampener is configured to absorb vibration along one or more of the contact spring or the movable contact.

In one or more embodiments of the present disclosure, an armature assembly of an electromechanical switch is provided that includes a movable contact, a support rod, a ferromagnetic plunger, a contact spring, and a dampener. The movable contact has a mating side and a mounting side opposite the mating side. The movable contact defines an opening therethrough. The support rod extends through the opening and couples to the movable contact. The support rod extends through an aperture in a divider wall of the electromechanical switch. The ferromagnetic plunger is coupled to the support rod along an opposite side of the divider wall from the movable contact. The contact spring surrounds the support rod between the movable contact and the divider wall. The dampener surrounds the support rod between the movable contact and the divider wall. The dampener engages the contact spring to absorb vibration along one or more of the contact spring or the movable contact.

In one or more embodiments of the present disclosure, an electromechanical switch is provided that includes a housing, first and second stationary contacts mounted to the housing; a movable contact, and a carrier sub-assembly. The housing has a divider wall. The movable contact has a mating side that faces the first and second stationary contacts and a mounting side opposite the mating side. The carrier sub-assembly is configured to move the movable contact relative to the first and second stationary contacts. The carrier sub-assembly includes a support rod, a contact spring, and a dampener. The support rod extends through an aperture in the divider wall and is coupled to the movable contact. The contact spring surrounds the support rod between the divider wall and the mounting side of the movable contact. The dampener has an O-ring shape and surrounds the support rod. The dampener has a first side in engagement with an end of the contact spring and a second side opposite the first side in engagement with the mounting side of the movable contact. The dampener includes an elastomeric material and is compressible to absorb vibration along one or more of the contact spring or the movable contact.

DETAILED DESCRIPTION OF THE INVENTION

Embodiments of the present disclosure provide an electromechanical switch, such as a relay or contactor, that is configured to selectively establish and break an electrical connection between a power source and an electrical device. The electromechanical switch may be configured to handle high electrical current, such as 500 Amperes (A) or greater.

At such high levels of electrical power conveyed across a mating interface between mating contacts, the mating contacts of known electromechanical switches are prone to oscillations and/or vibrations, which may generate an audible noise. The audible noise may be interpreted by observers as a high pitch squeal, which may distract and/or annoy the observers. The electromechanical switch according to the embodiments described herein is configured to eliminate the audible noise, or at least reduce the occurrence and magnitude of the noise. For example, the electromechanical switch includes a dampener in engagement with a spring that applies a biasing force on a movable contact. The dampener is configured to absorb oscillations and vibrations of the spring and/or the movable contact.

Figure 1:
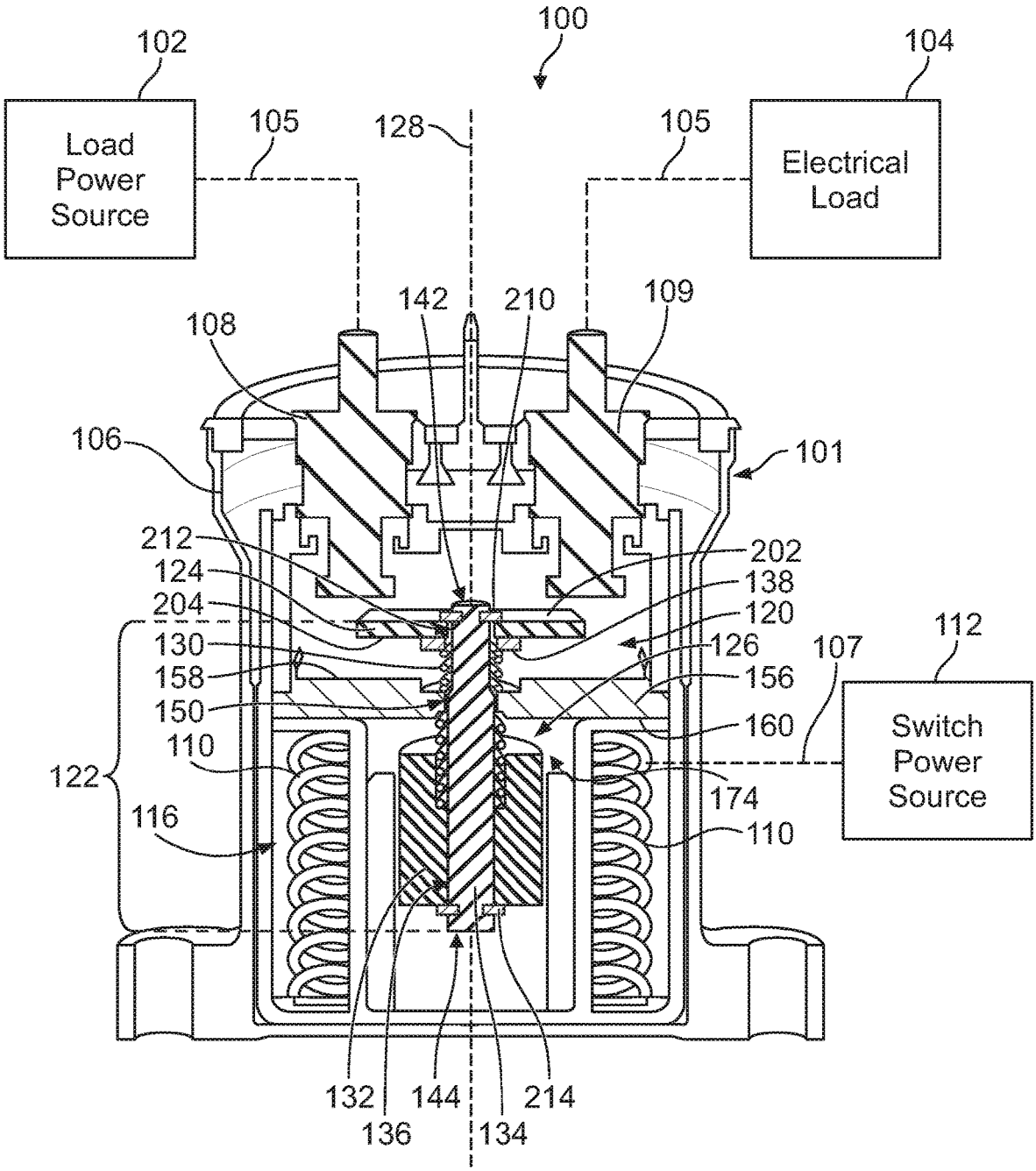
FIG. 1 is a schematic diagram of a power circuit formed in accordance with an embodiment showing a cross-sectional view of an electromechanical switch of the power circuit in an open state.

FIG. 1 is a schematic diagram of a power circuit 100 formed in accordance with an embodiment showing a cross-sectional view of an electromechanical switch 101 of the power circuit 100 in an open state. The power circuit 100 has several components including the electromechanical switch 101, a load power source 102, an electrical load 104, and a switch power source 112, as well as electrically conductive elements 105, such as wires, traces, and the like, interconnecting the components.

The electromechanical switch 101 is an electrically operated switch is used to selectively control the presence or absence of current flowing through the power circuit 100 from the load power source 102 to the electrical load 104. The electromechanical switch 101 closes (or establishes) a circuit to allow current to flow through the power circuit 100 from the load power source 102 to the electrical load 104 to power the load 104. The electromechanical switch 101 opens (or breaks) the circuit to stop the flow of current through the power circuit 100 to the electrical load 104. The electromechanical switch 101 may be a relay device or a contactor device.

In one non-limiting example application, the power circuit 100 may be installed within a vehicle, such as a hybrid or fully electric automobile. The load power source 102 may represent or include a battery. The electrical load 104 may represent or include a motor, a heating and/or cooling system, a lighting system, a vehicle electronics system, or the like. The electromechanical switch 101 may also be used to convey electrical current in the reverse direction from the electrical load 104 to the load power source 102 for charging the load power source 102, such as during regenerative braking of the vehicle. In other applications, the power circuit 100 may be utilized in other types of vehicles, such as rail vehicles and marine vessels, in appliances, in industrial machinery, and the like.

The electromechanical switch 101 includes a housing 106, first and second stationary contacts 108, 109, and a movable contact 124. The first and second stationary contacts 108, 109 are mounted to the housing 106 and secured in fixed positions relative to the housing 106. The first stationary contact 108 is spaced apart from the second stationary contact 109. The first stationary contact 108 is electrically connected to the load power source 102, and the second stationary contact 109 is electrically connected to the electrical load 104. The electromechanical switch 101 is shown in FIG. 1 in an open state in which the movable contact 124 is not engaged with the stationary contacts 108, 109, such that an electrical connection is not established. In the open state, the load power source 102 is disconnected from the electrical load 104.

Figure 2:
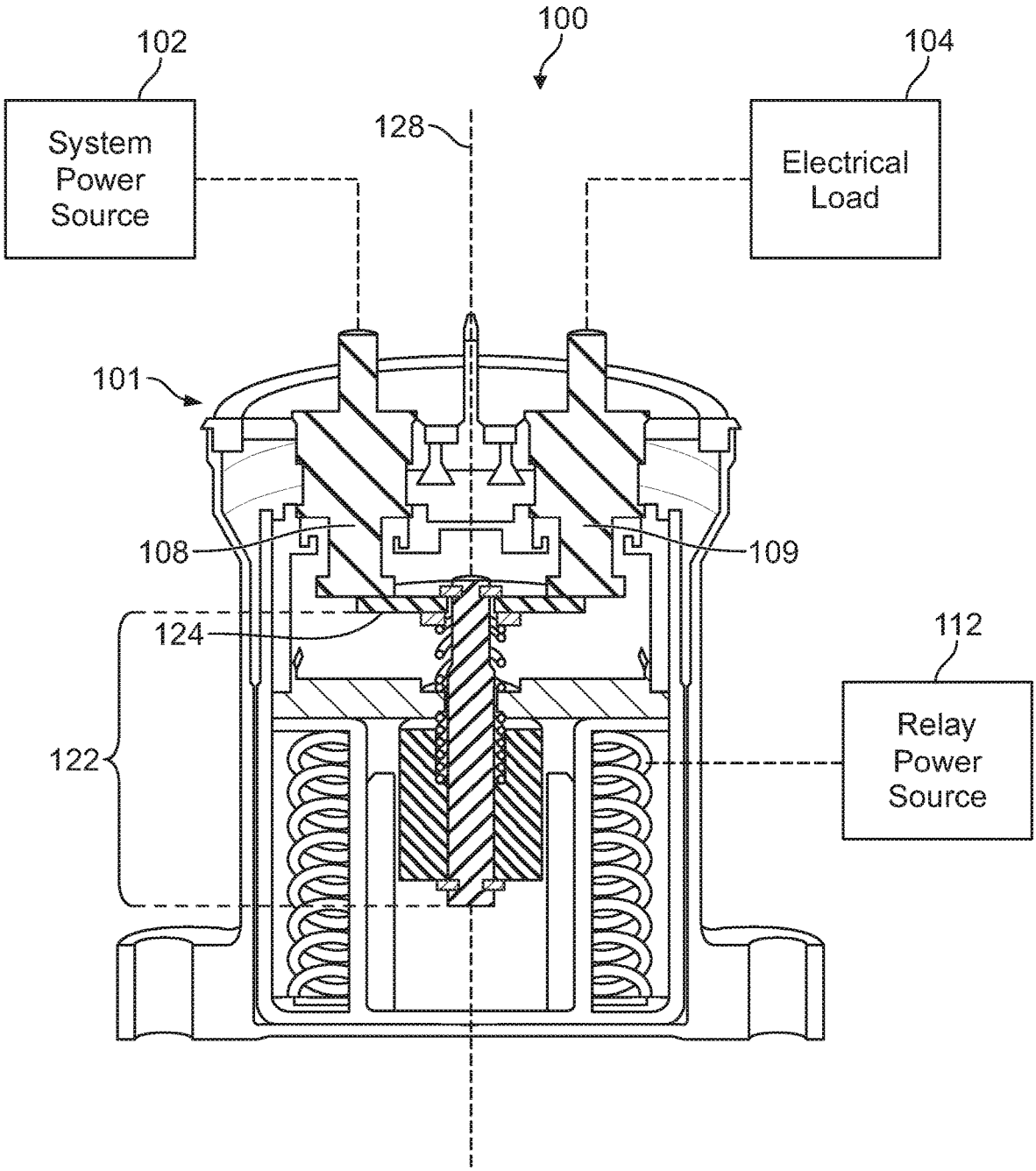
FIG. 2 is a schematic diagram of the power circuit with the electromechanical switch in a closed state in which a movable contact engages stationary contacts.

The movable contact 124 includes a mating side 202 and a mounting side 204 that is opposite the mating side 202. The mating side 202 faces the first and second stationary contacts 108, 109. When the electromechanical switch 101 is in a closed position (as shown in FIG. 2), the movable contact 124 engages both the first and second stationary contacts 108, 109.

The electromechanical switch 101 further includes a coil 110 of wire (referred to herein as wire coil 110) within the housing 106. The wire coil 110 is electrically connected, via one or more conductive elements 107, to a switch power source 112 which provides electrical current to the wire coil 110 to induce a magnetic field. The switch power source 112 may be operated to selectively control the magnetic field induced by the wire coil 110.

The movable contact 124 is coupled to a carrier sub-assembly 126. The movable contact 124 and the carrier sub-assembly 126 together define an armature assembly 122 of the electromechanical switch 101. The armature assembly 122 moves bi-directionally along an actuation axis 128 relative to the stationary contacts 108, 109. In an embodiment, the movement of the armature assembly 122 may be based on the presence or absence of a magnetic field induced by current through the wire coil 110. For example, responsive to the switch power source 112 supplying current to the wire coil 110, the induced magnetic field acts on the carrier sub-assembly 126 and causes the carrier sub-assembly 126, and the movable contact 124 coupled thereto, to move along the actuation axis 128 towards the stationary contacts 108, 109. In response to the switch power source 112 stopping the current, the armature assembly 122 may axially return towards a starting position due to biasing forces, such as gravity and/or spring forces. Alternatively, the magnetic field induced by the coil 110 may force movement of the armature assembly 122 in the direction away from the stationary contacts 108, 109, which disconnects the movable contact 124 from the stationary contacts 108, 109.

The carrier sub-assembly 126 includes a support rod 134, a plunger 132, a contact spring 130, and a dampener 138. The support rod 134 is elongated between a first end 142 and an opposite second end 144 of the support rod 134. The support rod 134 is coupled to the movable contact 124 at or proximate to the first end 142. For example, the first end 142 may extend through an opening 212 in the movable contact 124 that extends from the mating side 202 to the mounting side 204. The first end 142 may be coupled to the movable contact 124 via a clip 210 that engages the mating side 202 of the movable contact 124. In an alternative embodiment, the first end 142 of the support rod 134 may include deflectable prongs that latch onto the movable contact 124 instead of utilizing the clip 210. The support rod 134 is coupled to the plunger 132 at or proximate to the second end 144. For example, the second end 144 may extend into a channel 136 of the plunger 132 to secure the support rod 134 to the plunger 132 via a clip 214. Alternatively, the support rod 134 may secure to the plunger 132 via an interference fit, one or more deflectable latching features, an adhesive, and/or the like. The plunger 132 is fixedly secured to the support rod 134. The movable contact 124 may be movably coupled to the support rod 134 such that the movable contact 124 is able to move axially relative to the support rod 134 towards the second end 144. The movable contact 124 and the plunger 132 are spaced apart from one another along a length of the support rod 134.

The housing 106 includes a divider wall 156 that is located between the movable contact 124 and the wire coil 110. The housing 106 in the illustrated embodiment is a vessel that defines an interior chamber 174. The divider wall 156 segments the chamber 174 into a contact region 120 and an electromagnetic region 116. The stationary contacts 108, 109 and the movable contact 124 are located at least partially within the contact region 120. For example, the stationary contacts 108, 109 project out of the chamber 174 of the housing 106 to electrically connect to the conductive elements 105. The wire coil 110 is disposed within the electromagnetic region 116.

The armature assembly 122 extends into both the contact region 120 and the electromagnetic region 116. For example, the divider wall 156 defines an aperture 150 extending from a top side 158 of the divider wall 156 through a bottom side 160 of the divider wall 156. As used herein, relative or spatial terms such as "top," "bottom," "inner," "outer," "upper," and "lower" are only used to distinguish the referenced elements and do not necessarily require particular positions or orientations in the surrounding environment of the electromechanical switch 101. The support rod 134 extends through the aperture 150. The movable contact 124 and the plunger 132 are located along opposite sides of the divider wall 156. The movable contact 124 is located within the contact region 120, and the plunger 132 is located within the electromagnetic region 116. The armature assembly 122 moves relative to the divider wall 156 along the actuation axis 128.

The plunger 132 within the electromagnetic region 116 is circumferentially surrounded by the wire coil 110. The plunger 132 may be formed of a ferromagnetic material. For example, the plunger 132 may be formed of iron, nickel, cobalt, and/or an alloy containing one or more of iron, nickel, and cobalt. The plunger 132 has magnetic properties that allow the plunger 132 to translate in the presence of the magnetic field induced by the wire coil 110. The movement of the plunger 132 causes the entire armature assembly 122 to move along the actuation axis 128.

The contact spring 130 surrounds the support rod 134. The contact spring 130 is located within the contact region 120 between the movable contact 124 and the divider wall 156. The contact spring 130 is a coil spring in the illustrated embodiment. The contact spring 130 may be compressed between the movable contact 124 and the divider wall 156 to force the movable contact 124 into sustained engagement with the clip 210. The contact spring 130 may directly or indirectly engage the mounting side 204 of the movable contact 124, and may directly or indirectly engage the top side 158 of the divider wall 156. In the illustrated embodiment, the contact spring 130 directly engages the top side 158 of the divider wall 156 and indirectly engages the mounting side 204 of the movable contact 124 via the dampener 138. The dampener 138 is sandwiched between the contact spring 130 and the movable contact 124. As described is more detail herein, the dampener 138 is absorbs and/or dissipates vibration and oscillation of the movable contact 124 and/or the contact spring 130 to eliminate or at least prohibit the generation of an audible noise when the electromechanical switch 101 is in the closed state shown in FIG. 2.

FIG. 2 is a schematic diagram of the power circuit 100 of FIG. 1 with the electromechanical switch 101 in the closed state in which the movable contact 124 engages the stationary contacts 108, 109. The closed state is achieved by the armature assembly 122 moving from the position shown in FIG. 1 towards the stationary contact 108, 109 along the actuation axis 128.

The movable contact 124 is conductively coupled to both stationary contacts 108, 109. The movable contact 124 provides a closed circuit path between the two stationary contacts 108, 109. For example, electrical current is allowed to flow between the stationary contacts 108, 109 through the movable contact 124 that forms a conductive bridge. In the illustrated embodiment, in the closed state of the electromechanical switch 101, electrical current from the system power source 102 is conveyed through the contacts 108, 124, 109 to the electrical load 104 to power the load 104. The electromechanical switch 101 may transition to the open state shown in FIG. 1 in response to the armature assembly 122 moving away from the stationary contacts 108, 109, causing the movable contact 124 to disengage the stationary contacts 108. The disconnection breaks the circuit and stops the flow of electrical current between the system power source 102 and the electrical load 104.

Although two stationary contacts 108, 109 and one movable contact 124 are shown in FIGS. 1 and 2, it is recognized that the electromechanical switch 101 in other embodiments may have a different number of stationary contacts and/or a different number of movable contacts. Furthermore, the electromechanical switch 101 in other embodiments may have a different arrangement of stationary and movable contacts. For example, a single movable contact may be permanently fixed a first stationary contact, and may be configured to move relative to a second stationary contact, in order to close and open a circuit between the first and second stationary contacts.

Figure 3:
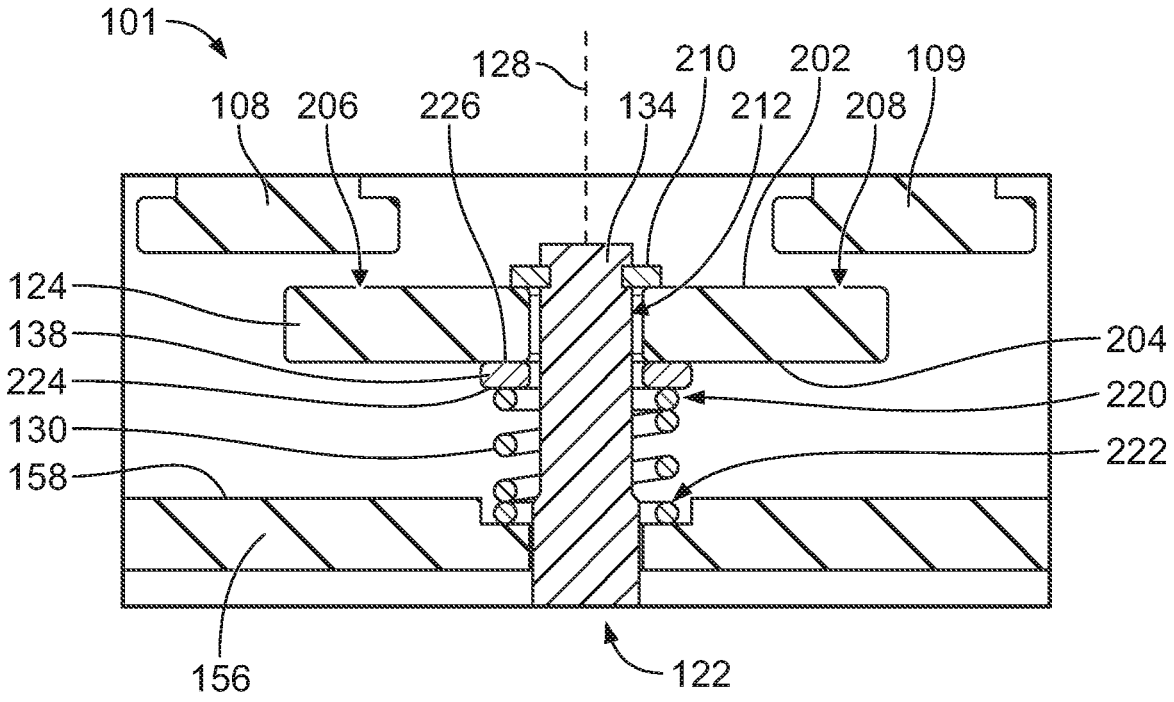
FIG. 3 is an enlarged view of a portion of the electromechanical switch in the open state as shown in FIG. 1.

FIG. 3 is an enlarged view of a portion of the electromechanical switch 101 in the open state as shown in FIG. 1. The mating side 202 of the movable contact 124 includes a first contact zone 206 and a second contact zone 208. The first contact zone 206 aligns with the first stationary contact 108, and the second contact zone 208 aligns with the second stationary contact 109. In the illustrated embodiment, the first contact zone 206 is disposed under the first stationary contact 108, and the second contact zone 208 is disposed under the second stationary contact 109. In order to achieve the closed state shown in FIG. 2, the armature assembly 122 moves along the actuation axis 128 until the first contact zone 206 engages the first stationary contact 108 and the second contact zone 208 engages the second stationary contact 109. The first and second contact zones 206, 208 are spaced apart from each other along the width of the movable contact 124. The support rod 134 may be coupled to the movable contact 124 between the first and second contact zones 206, 208. For example, the opening 212 that receives the support rod 134 may be located between the first and second contact zones 206, 208.

The contact spring 130 is configured to control the spacing between the movable contact 124 and the divider wall 156. For example, the contact spring 130 may force the movable contact 124 into sustained engagement between the clip 210 and the mating side 202 of the movable contact 124. The contact spring 130 is engaged by the dampener 138. The contact spring 130 extends between a contact end 220 of the spring 130 and a structure end 222 of the spring 130. The contact end 220 is at or proximate to the movable contact 124, and the structure end 222 is at or proximate to the top side 158 of the divider wall 156. The contact spring 130 in the illustrated embodiment is a helical coil spring that surrounds the segment of the support rod 134 between the movable contact 124 and the divider bridge 156.

The dampener 138 has a first side 224 and a second side 226 opposite the first side 224. In the illustrated embodiment, the dampener 138 is disposed between the contact spring 130 and the movable contact 124. For example, the first side 224 of the dampener 138 engages the contact end 220 of the contact spring 130, and the second side 226 engages the mounting side 204 of the movable contact 124. The dampener 138 is sandwiched between the contact spring 130 and the movable contact 124. The dampener 138 may at least partially compress or deform due to the forces exerted on the dampener 138 by the spring 130 and the movable contact 124. The dampener 138 absorbs and/or dissipates vibration and oscillation of the spring 130 and/or the movable contact 124. The dampener 138 in the illustrated embodiment circumferentially surrounds the support rod 134.

The structure end 222 of the contact spring 130 in the illustrated embodiment engages the divider wall 156, and the contact end 220 indirectly engages the movable contact 124 via the dampener 138.

Figure 4:
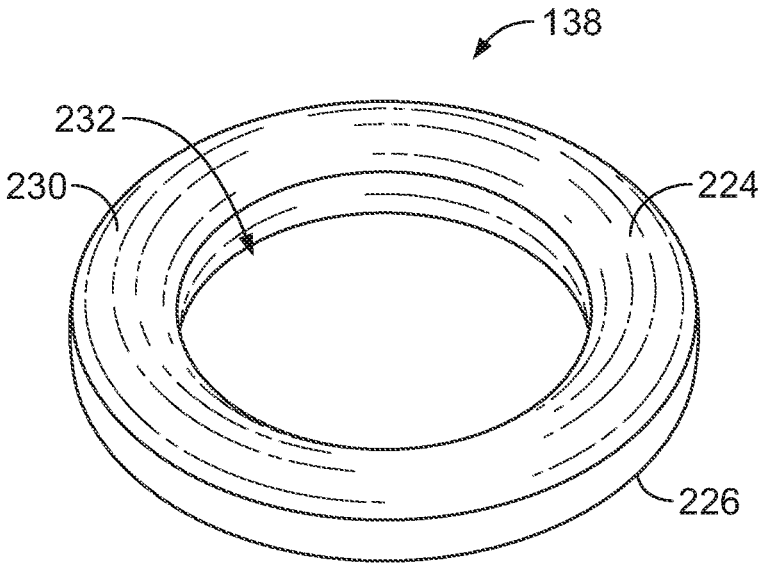
FIG. 4 is a perspective view of a dampener of the electromechanical switch according to an embodiment.

FIG. 4 is a perspective view of the dampener 138 of the electromechanical switch 101 according to an embodiment. The dampener 138 is an O-ring, such that the dampener 138 has an annular body 230 that defines a central cavity 232. The dampener 138 may be loaded onto the support rod 134 (shown in FIG. 3) such that the support rod 134 extends through the central cavity 232. The annular body 230 may have a circular cross-sectional shape (e.g., like a donut) as shown in FIG. 4. The dampener 138 may be configured to compress and/or deform to adopt a flattened state when installed in the electromechanical switch 101. For example, the dampener 138 may be in the flattened state in FIG. 3. In an alternative embodiment, the body 230 of the dampener 138 may include one or more flat surfaces when in an uncompressed state, such as flat surfaces along the first and second sides 224, 226 thereof and curved surfaces between the flat surfaces.

The dampener 138 may include one or more elastomeric materials. For example, the dampener 138 may include thermoplastic elastomers, natural rubber, synthetic rubber, silicone, or the like. In one non-limiting example, the elastomeric material may be or include perfluoroelastomer (FFKM). The elastomeric material may provide the dampener 138 with compressible and/or deformable properties, which allow the dampener 138 to reduce vibrations and/or oscillations of the contact spring 130 and/or the movable contact 124.

Figure 5:
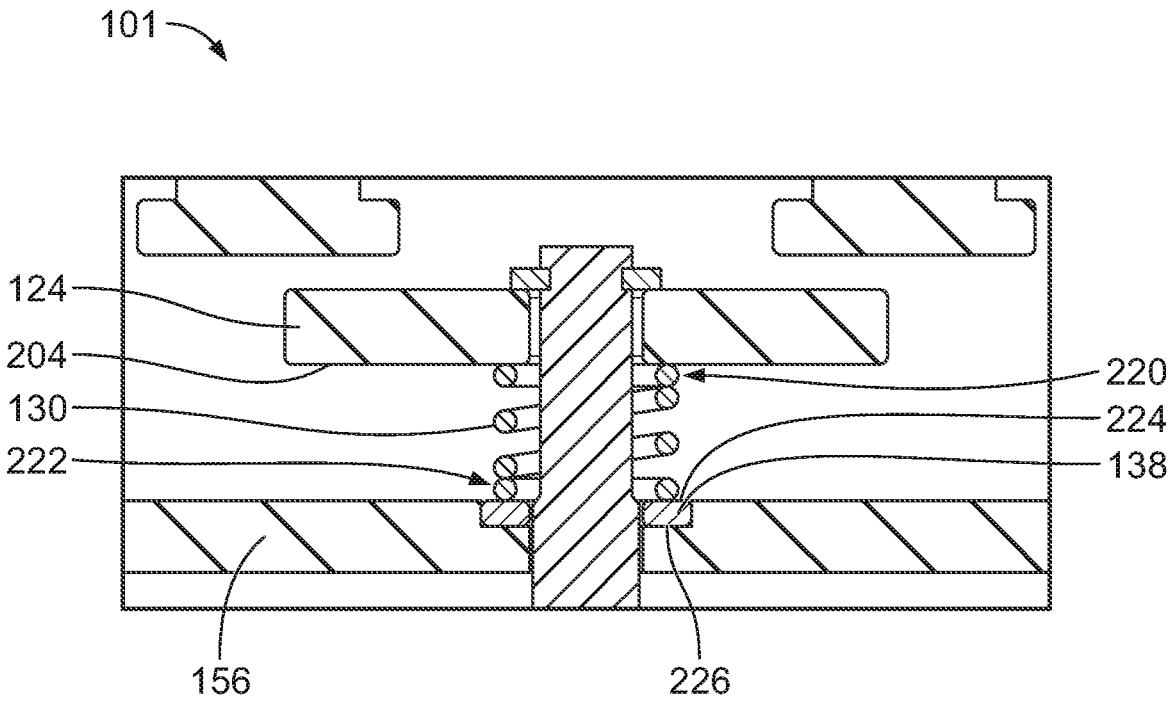
FIG. 5 is an enlarged view of a portion of the electromechanical switch in the open state according to an alternative embodiment.

FIG. 5 is an enlarged view of a portion of the electromechanical switch 101 in the open state according to an alternative embodiment. The illustrated embodiment differs from the embodiment shown in FIG. 3 in the arrangement of the contact spring 130 and the dampener 138 between the movable contact 124 and the divider wall 156. In FIG. 5, the dampener 138 is sandwiched between the contact spring 130 and the divider wall 156. The first side 224 of the dampener 138 engages the structure end 222 of the contact spring 130, and the second side 226 of the dampener 138 engages the divider wall 156. The dampener 138 may absorb vibrations and/or oscillations of the contact spring 130. The dampener 138 is spaced apart from the movable contact 124. The contact end 220 of the contact spring 130 may engage the mounting side 204 of the movable contact 124. The dampener 138 shown in FIG. 5 optionally may be similar in size and/or shape as the dampener 138 shown in FIGS. 3 and 4.

In another alternative embodiment, the electromechanical switch 101 may have multiple dampeners including a first dampener 130 at the location shown in FIG. 3 and a second dampener 130 at the location shown in FIG. 5.

Figure 6:
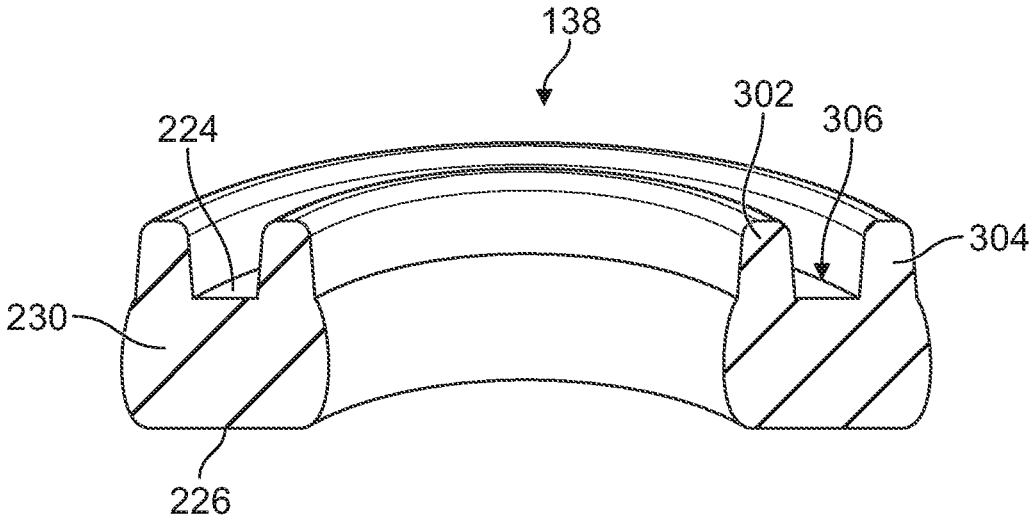
FIG. 6 is a cross-sectional perspective view of the dampener of the electromechanical switch according to an alternative embodiment.

FIG. 6 is a cross-sectional perspective view of the dampener 138 of the electromechanical switch 101 according to an alternative embodiment. The dampener 138 in the illustrated embodiment includes an inner lip 302 and an outer lip 304 that protrude beyond the first side 224. The inner and outer lips 302, 304 extend circumferentially along the annular body 230. The outer lip 304 is located at a perimeter of the dampener 138. The inner lip 302 is radially spaced apart from the outer lip 304 to define a radial gap 306 therebetween. In an embodiment, an end segment of the contact spring 130 (shown in FIG. 5) is received into the radial gap 306 and engages at least one of the inner and outer lips 302, 304. For example, the outer lip 304 may engage and surround the structure end 222 of the contact spring 130 according to the arrangement shown in FIG. 5, or the outer lip 304 may engage and surround the contact end 220 of the contact spring 130 according to the arrangement shown in FIG. 3. The lips 302, 304 may enable the dampener 138 to secure onto the contact spring 130, and may enhance the absorption of vibration and oscillation of the contact spring 130 and/or the movable contact 124.

The second side 226 of the dampener 138 lacks lips and may be similar to the second side 226 shown in FIG. 4. Although the dampener 138 includes both an inner lip 302 and an outer lip 304 in the illustrated embodiment, in an alternative embodiment the dampener 138 may have only the outer lip 304 or only the inner lip 302 but not both.

Figure 7:
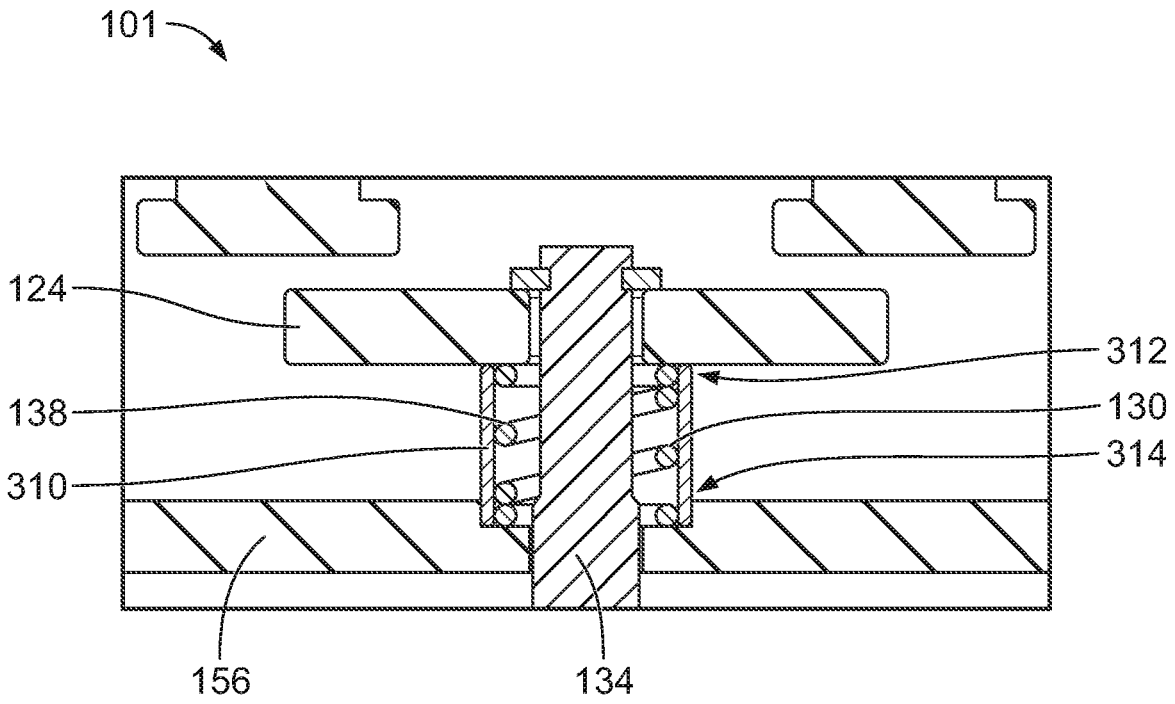
FIG. 7 is an enlarged view of a portion of the electromechanical switch in the open state according to another alternative embodiment.
Figure 8:
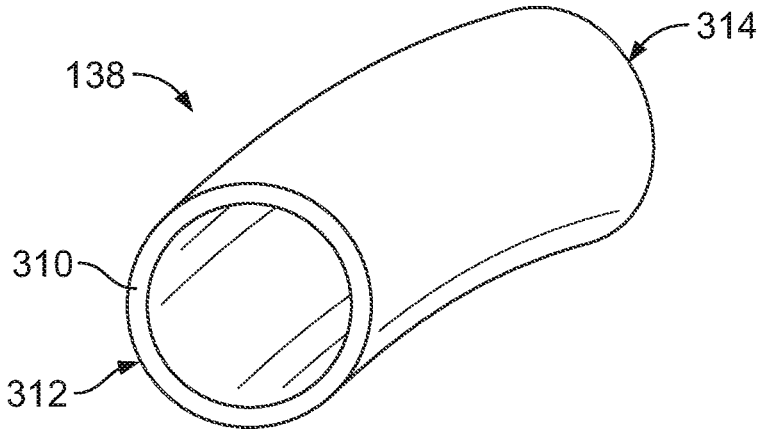
FIG. 8 is a perspective view of the dampener of the electromechanical switch according to the embodiment shown in FIG. 7.

FIG. 7 is an enlarged view of a portion of the electromechanical switch 101 in the open state according to another alternative embodiment. FIG. 8 is a perspective view of the dampener 138 of the electromechanical switch 101 according to the embodiment shown in FIG. 7. The dampener 138 in FIGS. 7 and 8 is a hollow tube 310 or sleeve. The hollow tube 310 circumferentially surrounds both the support rod 134 and the contact spring 130. The hollow tube 310 surrounds the contact spring 130 along at least a segment of the contact spring 130 between the movable contact 124 and the divider wall 156. In an embodiment in which the hollow tube 310 extends the entire length of the contact spring 130, first and second ends 312, 314 of the hollow tube 310 may engage the movable contact 124 and the divider wall 156, respectively. Alternatively, one or both of the ends 312, 314 may be spaced apart from the movable contact 124 and/or the divider wall 156. The hollow tube 310 dampens vibrations and/or oscillations along the length of the contact spring 130.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electromechanical switch comprising:

a housing having a divider wall;

first and second stationary contacts mounted to the housing;

a movable contact that includes a mating side that faces the first and second stationary contacts and a mounting side opposite the mating side; and a carrier sub-assembly configured to move the movable contact relative to the first and second stationary contacts, the carrier sub-assembly comprising:

a support rod that extends through an aperture in the divider wall and is coupled to the movable contact;

a contact spring surrounding the support rod between the divider wall and the movable contact; and a dampener having a first side that engages a contact end of the contact spring and a second side opposite the first side that engages the mounting side of the movable contact, wherein the dampener is composed of an elastomeric material that is deformed due to a spring force exerted on the dampener by the contact spring, and in response to the spring force, the elastomeric material forces the second side of the dampener against the movable contact, wherein the elastomeric material supports the movable contact by absorbing vibration exerted on the movable contact.

2. The electromechanical switch of claim 1, wherein the dampener is a first dampener and the electromechanical switch further includes a second dampener, wherein the second dampener has a first side that engages a structure end of the contact spring opposite the contact end and a second side opposite the first side that engages the divider wall.

3. The electromechanical switch of claim 1, wherein the dampener has an annular shape and circumferentially surrounds the support rod.

4. The electromechanical switch of claim 1, wherein the dampener has an annular shape and circumferentially surrounds the support rod, the dampener including an outer lip that protrudes beyond the first side along a perimeter of the dampener, the outer lip engaging and at least partially surrounding the contact end of the contact spring.

5. The electromechanical switch of claim 4, wherein the dampener includes an inner lip that is annular and protrudes beyond the first side, the inner lip is spaced apart from the outer lip to define a radial gap, the contact end of the contact spring disposed in the radial gap and engaged by both the inner lip and the outer lip to secure the dampener onto the contact end of the contact spring.

6. The electromechanical switch of claim 1, wherein the dampener is a hollow tube and circumferentially surrounds the contact spring along at least a segment of the contact spring between the movable contact and the divider wall.

7. The electromechanical switch of claim 1, wherein the carrier sub-assembly includes a ferromagnetic plunger coupled to the support rod along an opposite side of the divider wall from the movable contact, the ferromagnetic plunger configured to move the carrier sub-assembly and the movable contact along an actuation axis relative to the first and second stationary contacts based on a presence or absence of a magnetic field induced by current through a coil of wire that surrounds the ferromagnetic plunger.

8. The electromechanical switch of claim 1, wherein the support rod is coupled to the movable contact via a clip, the contact spring forcing the mating side of the movable contact into sustained engagement with the clip.

9. The electromechanical switch of claim 1, wherein the mating side of the movable contact defines first and second contact zones that are spaced apart from each other, the first contact zone engaging the first stationary contact and the second contact zone engaging the second stationary contact responsive to the carrier sub-assembly moving the movable contact into engagement with the first and second stationary contacts, wherein the support rod is coupled to the movable contact between the first and second contact zones.

10. The electromechanical switch of claim 1, wherein the elastomeric material of the dampener comprises silicone.

11. The electromechanical switch of claim 1, wherein the elastomeric material of the dampener comprises natural rubber or synthetic rubber.

12. The electromechanical switch of claim 1, wherein the elastomeric material of the dampener comprises perfluoroelastomer (FFKM).

13. An armature assembly of an electromechanical switch comprising:

a movable contact having a mating side and a mounting side opposite the mating side, the movable contact defining an opening therethrough;

a support rod extending through the opening and coupling to the movable contact, the support rod extending through an aperture in a divider wall of the electromechanical switch;

a ferromagnetic plunger coupled to the support rod along an opposite side of the divider wall from the movable contact;

a contact spring surrounding the support rod between the movable contact and the divider wall; and a dampener surrounding the support rod and disposed between the movable contact and the contact spring, the dampener including a first side that engages an end of the contact spring, the dampener including an upper lip and an outer lip that protrude beyond the first side, the inner lip spaced apart from the outer lip to define a radial gap that receives the end of the contact spring therein, wherein a width of the radial gap is no greater than an annular thickness of the end of the contact spring such that the end of the spring is gripped by both the inner lip and the outer lip.

14. The armature assembly of claim 13, wherein the dampener includes an elastomeric material and is compressible.

15. The armature assembly of claim 14, wherein the inner lip and the outer lip of the dampener are composed of the elastomeric material, and the width of the radial gap is at least slightly smaller than the annular thickness of the end of the contact spring such that at least one of the inner lip or the outer lip deflects to expand the width of the radial gap as the end of the contact spring is received within the radial gap.

16. The armature assembly of claim 13, wherein the dampener is an O-ring.

17. The armature assembly of claim 13, wherein the radial gap has a height that extends from the first side of the dampener between the inner and outer lips to respective distal ends of the inner and outer lips, the width of the radial gap being greater at the distal ends of the inner and outer lips than the width of the radial gap at the first side between the inner and outer lips.

18. An electromechanical switch comprising:

a housing having a divider wall;

first and second stationary contacts mounted to the housing;

a movable contact having a mating side that faces the first and second stationary contacts and a mounting side opposite the mating side; and a carrier sub-assembly configured to move the movable contact relative to the first and second stationary contacts, the carrier sub-assembly comprising:

a support rod that extends through an aperture in the divider wall and is coupled to the movable contact;

a contact spring surrounding the support rod between the divider wall and the mounting side of the movable contact; and a dampener having an O-ring shape and surrounding the support rod, the dampener having a first side in engagement with an end of the contact spring and a second side opposite the first side in engagement with the mounting side of the movable contact, wherein the dampener is composed of an elastomeric material that is deformed due to a spring force exerted on the dampener by the contact spring, and in response to the spring force, the elastomeric material forces the second side of the dampener against the movable contact, wherein the elastomeric material supports the movable contact by absorbing vibration exerted on the movable contact.

19. The electromechanical switch of claim 18, wherein the carrier sub-assembly further comprises a ferromagnetic plunger coupled to the support rod along an opposite side of the divider wall from the movable contact, the ferromagnetic plunger configured to move the carrier sub-assembly and the movable contact relative to the first and second stationary contacts based on a presence or absence of a magnetic field induced by current through a coil of wire surrounding the ferromagnetic plunger.

20. The electromechanical switch of claim 18, wherein the mating side of the movable contact defines first and second contact zones that are spaced apart from each other, the first contact zone engaging the first stationary contact and the second contact zone engaging the second stationary contact responsive to the carrier sub-assembly moving the movable contact into engagement with the first and second stationary contacts, wherein the support rod is coupled to the movable contact between the first and second contact zones.

* * * * *